US009022780B2

(12) United States Patent
Padgett

(10) Patent No.: US 9,022,780 B2
(45) Date of Patent: May 5, 2015

(54) OVAL BURNER ALIGNMENT METHOD

(75) Inventor: Michael Padgett, Austin, KY (US)

(73) Assignee: Electrolux Home Products, Inc., Charlotte, NC (US)

( * ) Notice: Subject to any disclaimer, the term of this patent is extended or adjusted under 35 U.S.C. 154(b) by 1281 days.

(21) Appl. No.: 12/258,771

(22) Filed: Oct. 27, 2008

(65) Prior Publication Data

US 2010/0104992 A1 Apr. 29, 2010

(51) Int. Cl.
*F23D 14/06* (2006.01)
*F23D 14/46* (2006.01)

(52) U.S. Cl.
CPC ..... *F23D 14/06* (2013.01); *F23D 14/46* (2013.01); *F23D 2900/00017* (2013.01); *F23D 2900/14064* (2013.01)

(58) Field of Classification Search
CPC ..... F23D 21/005; F23D 21/00; F23D 99/00; F23D 2900/14064; F23D 2900/14062; F23D 2900/14063; F23C 5/02; F23C 5/08; F23C 2700/043; F24C 3/008; F24C 3/027; F24C 3/085
USPC ..... 431/202, 343, 354, 355; 126/39 A, 39 C, 126/39 E, 39 R; 239/600; 285/19, 20, 27, 285/402; 279/89, 93, 104; 138/155, 109
IPC ..... F23D 14/06, 14/46
See application file for complete search history.

(56) References Cited

U.S. PATENT DOCUMENTS 1,329,224 A * 1/1920 Brazil ..... 431/211
1,481,665 A * 1/1924 Elliott ..... 126/53
1,968,978 A * 8/1934 White ..... 431/266
3,287,031 A * 11/1966 Simmons et al. ..... 285/27
3,319,693 A * 5/1967 Bryant et al. ..... 126/92 R
3,385,525 A * 5/1968 Jacobs ..... 239/394
3,991,446 A * 11/1976 Mooney et al. ..... 411/548

(Continued)

FOREIGN PATENT DOCUMENTS

CN 2382954 6/2000
EP 485645 A1 * 5/1992 ..... F23D 14/06

(Continued)

OTHER PUBLICATIONS

International Search Report for PCT/US2009/061448, dated Jan. 7, 2010, 3 pages.

*Primary Examiner* — Gregory Huson
*Assistant Examiner* — Daniel E Namay
(74) *Attorney, Agent, or Firm* — Pearne & Gordon LLP

(57) ABSTRACT

An apparatus includes a gas burner assembly which includes a gas burner and a gas supply conduit. The gas burner includes a gas supply opening and a substantially cylindrical socket formed on the exterior of the gas burner around the gas supply opening. The gas supply conduit includes an opening at an end and a substantially tubular adjoining section proximate to the opening. The adjoining section is configured to mate with the socket and includes a substantially radial protrusion. The socket includes a substantially radial depression for receiving the protrusion. As the gas supply conduit is connected with the gas burner to establish fluid communication at the gas supply opening, the protrusion is engaged in the depression thereby aligning the adjoining section in a predetermined manner about the socket and restricting rotational movement of the adjoining section about the socket.

19 Claims, 3 Drawing Sheets

(56) References Cited

U.S. PATENT DOCUMENTS

| | | | | |
|---|---|---|---|---|
| 4,280,723 | A * | 7/1981 | Moldestad | 285/376 |
| 4,478,205 | A | 10/1984 | Koziol | |
| 4,773,384 | A | 9/1988 | Koziol | |
| 5,676,539 | A | 10/1997 | Draper | |
| 6,089,219 | A * | 7/2000 | Kodera et al. | 126/39 R |
| 6,095,133 | A | 8/2000 | Walters | |
| 6,530,682 | B2 * | 3/2003 | Wu | 362/413 |
| 7,527,495 | B2 | 5/2009 | Yam et al. | |
| 2003/0075923 | A1 * | 4/2003 | Lepoutre | 285/330 |
| 2005/0142511 | A1 | 6/2005 | Yam | |
| 2006/0022465 | A1 * | 2/2006 | Yamauchi | 285/402 |
| 2007/0151556 | A1 * | 7/2007 | Cadima | 126/39 E |
| 2007/0236018 | A1 * | 10/2007 | Husmann et al. | 285/401 |
| 2008/0149090 | A1 * | 6/2008 | Lee et al. | 126/39 E |
| 2008/0227045 | A1 * | 9/2008 | Deng | 431/354 |
| 2011/0083618 | A1 * | 4/2011 | O'Donnell et al. | 122/17.1 |

FOREIGN PATENT DOCUMENTS

| | | | | |
|---|---|---|---|---|
| GB | 2004479 A | * | 4/1979 | B23B 31/04 |
| JP | 03099109 A | * | 4/1991 | F23D 14/46 |
| WO | WO 9401223 A1 | * | 1/1994 | B05B 15/06 |

* cited by examiner

OVAL BURNER ALIGNMENT METHOD

FIELD OF THE INVENTION

The present invention relates generally to gas burner assemblies, and more particularly, to assemblies for gas burners having unconventional shapes.

BACKGROUND OF THE INVENTION

Gas burners with non-circular bases are known in the art. Like circular gas burners, unconventionally shaped gas burners are supplied with a gas flow that must be distributed to the perimeter of the burner to generate a flame that is evenly spread about the gas burner. However, uniform distribution of gas to the perimeter is more difficult when unconventional shapes are involved. Moreover, if any components of the gas burner undergo deformation, it further contributes to an uneven distribution of gas to the perimeter of the burner. Thus, there is a need for devices and methods that facilitate even distribution of gas in gas burners with unconventional shapes.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

To achieve the foregoing and other aspects and in accordance with the present invention, an apparatus includes a gas burner assembly which includes a gas burner and a gas supply conduit. The gas burner includes a gas supply opening and a substantially cylindrical socket formed on the exterior of the gas burner around the gas supply opening. The gas supply conduit includes an opening at an end and a substantially tubular adjoining section proximate to the opening. The adjoining section is configured to mate with the socket and includes a substantially radial protrusion. The socket includes a substantially radial depression for receiving the protrusion. As the gas supply conduit is connected with the gas burner to establish fluid communication at the gas supply opening, the protrusion is engaged in the depression thereby aligning the adjoining section in a predetermined manner about the socket and restricting rotational movement of the adjoining section about the socket.

To achieve still further aspects and in accordance with the present invention, an apparatus includes a gas burner assembly which includes a gas burner and a gas supply conduit. The gas burner includes a gas supply opening and a cylindrical socket formed on the exterior of the gas burner in a concentric manner about the gas supply opening. The gas supply conduit includes an opening at an end and a tubular adjoining section configured to be concentric about the opening. The adjoining section is configured to mate with the socket and including at least one substantially radial protrusion. The socket includes a substantially radial depression for receiving the protrusion. The adjoining section is aligned in a predetermined manner about the socket as the protrusion engages the depression, and rotational movement of the adjoining section about the socket is thereby prevented.

To achieve still further aspects and in accordance with the present invention, an apparatus includes a gas burner assembly which includes a gas burner and a gas supply conduit. The gas burner includes a gas supply opening and a socket formed on the exterior of the gas burner around the gas supply opening. The socket includes a first part of an interlocking means. The gas supply conduit includes an opening at an end and an adjoining section proximate to the opening. The adjoining section is configured to mate with the socket and including a second part of the interlocking means. The first part and second part interlock so that, once the gas supply conduit is connected to the gas burner, rotational movement of the adjoining section about the socket is prevented by the interlocking means.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other aspects of the present invention will become apparent to those skilled in the art to which the present invention relates upon reading the following description with reference to the accompanying drawings.

DESCRIPTION OF EXAMPLE EMBODIMENTS

Figure 1:
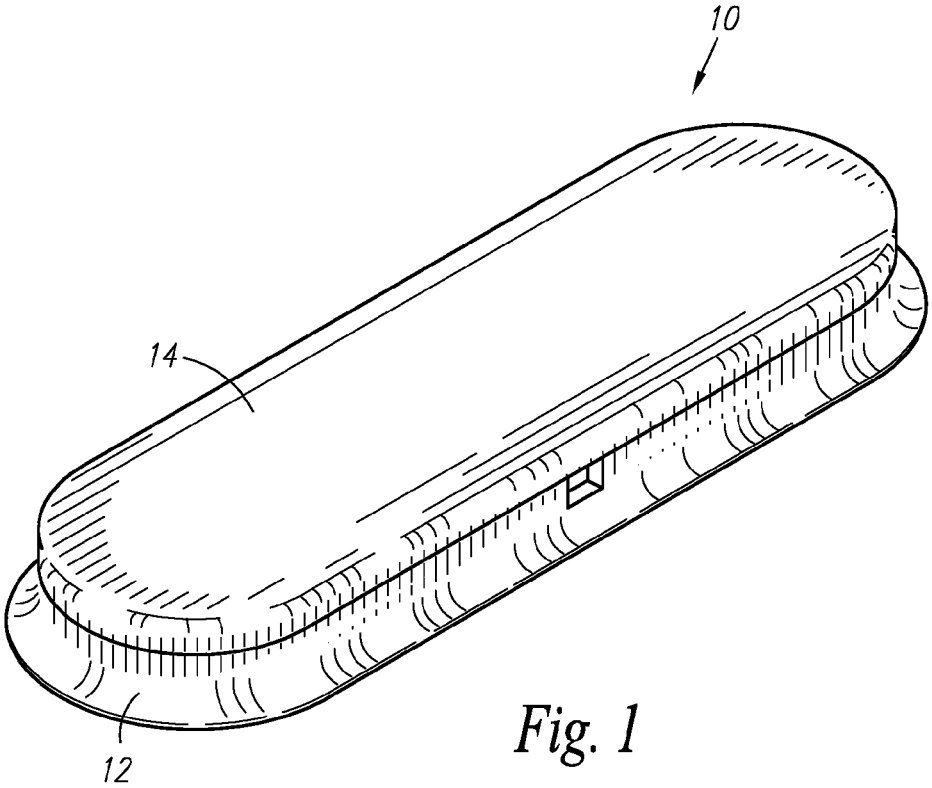
FIG. 1 is a perspective view of an example embodiment of a gas burner assembly in accordance with an aspect of the present invention.

The present invention relates to a gas burner assembly. The present invention will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 2:
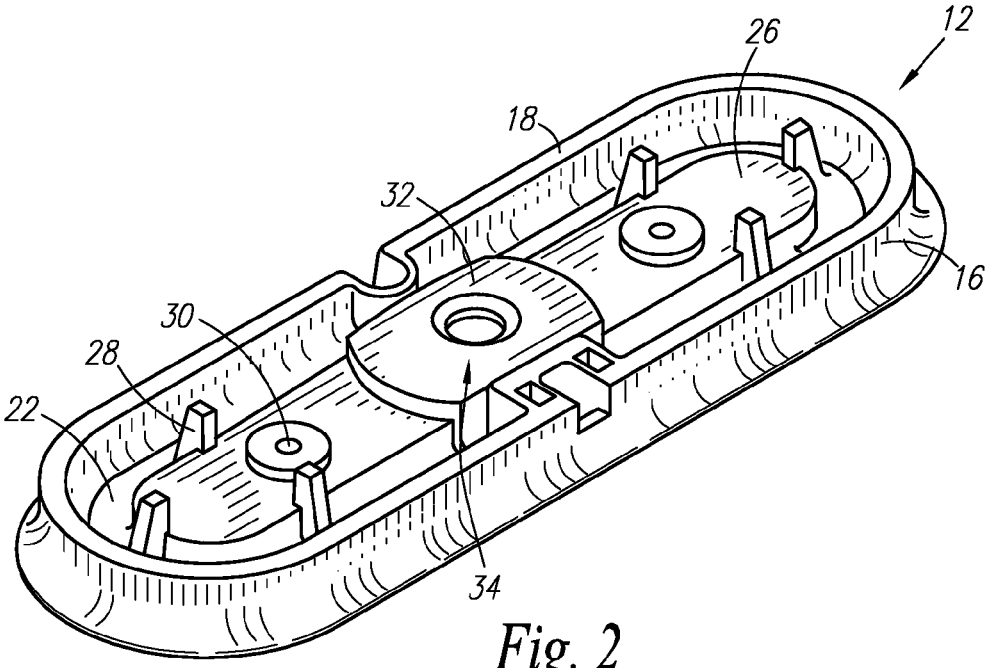
FIG. 2 is a perspective view of a body of the gas burner in accordance with an aspect of the present invention.

Turning to the shown example of FIG. 1, an example gas burner 10 in accordance with an aspect of the present invention is illustrated in an isolated state. The gas burner 10 comprises a body 12 and a cap 14. The body 12 has a bottom surface 24 (FIG. 3) that can be positioned on a surface 100, such as a cooktop shown in FIG. 7. As shown in FIG. 2, the body 12 has a sidewall 16 along the perimeter. In the present embodiment, the outer side of the sidewall 16 is tapered in a curved manner so that the circumference of the gas burner 10 gradually decreases from the bottom to the top. Although not shown in FIGS. 1 and 2, the sidewall includes a plurality of flame ports provided therein. The cap 14 is configured to correspond with the shape of the burner body and is removable positioned on the top portion of the body. For instance, a top surface 18 of the sidewall 16 can define a foundation on which the cap 14 of the gas burner 10 is placed. However it is to be appreciated that any suitable configuration of positioning a burner cap on a burner body can be used. When assembled together, the cap 14 and the body 12 form a gas flow chamber therebetween. As shown in FIG. 4, the sidewall 16 includes a plurality of flame ports 20, such as crenellations, and gas is allowed to flow from the chamber through the flame ports 20 after the cap 14 is placed over the body 12 of the gas burner 10. Combustion can thereafter take place outside the flame ports 20.

Figure 3:
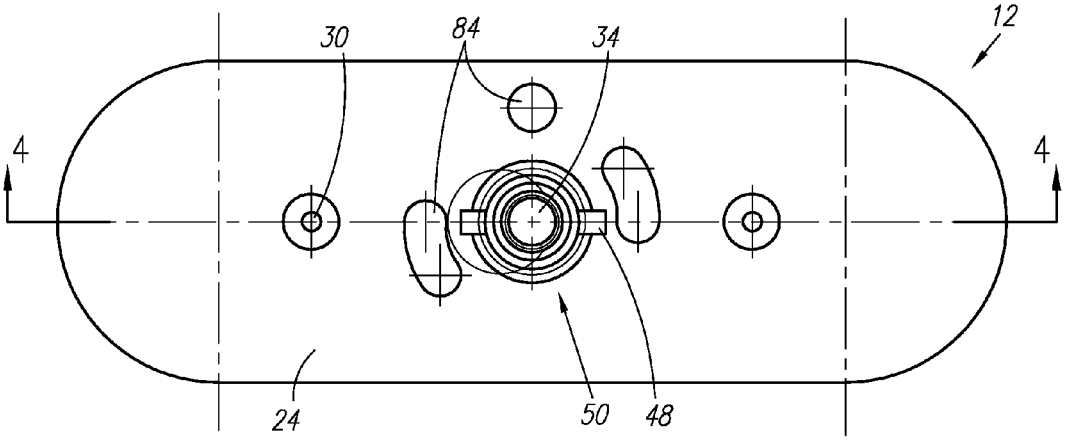
FIG. 3 is a bottom view of the body of the gas burner in accordance with an aspect of the present invention.
Figure 4:
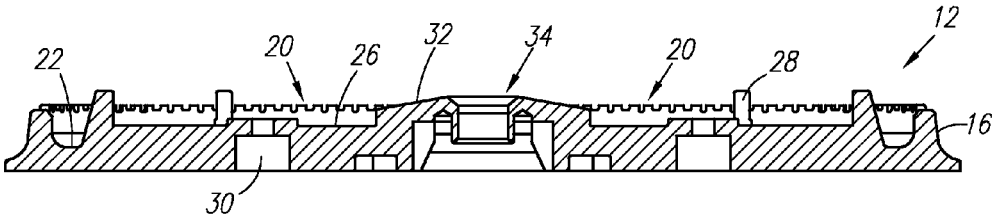
FIG. 4 is a side cross-sectional view of the body of the gas burner in accordance with an aspect of the present invention.

The body 12 has a top surface 22 (FIG. 2) and a bottom surface 24 (FIG. 3). A first elevated area 26 is formed on the top surface 22 and is located so as to have a common center with the top surface 22 in this embodiment. The first elevated area 26 is similar in shape to the top surface 22 but is smaller in area. Due to the presence of the first elevated area 26, a channel is created between the sidewall 16 and the first elevated area 26. The channel facilitates the flow of gas around the perimeter of the burner 10. The body 12 can also include one or more columns 28. In the present example, a plurality of columns 28 project from the top surface 22 and are provided at multiple locations on the outskirt of the first elevated area 26. The height of the columns 28 is configured so that the cap 14 of the gas burner 10 can be supported by the columns 28 at these multiple locations. Although not shown, the cap can include recessed portions on an underside thereof that correspond with the columns to facilitate alignment of the cap with the body. The first elevated area 26 can also include apertures 30 that extend through the body 12 such that the body 12 can be secured to the mounting surface 100 using fasteners.

Figure 5:
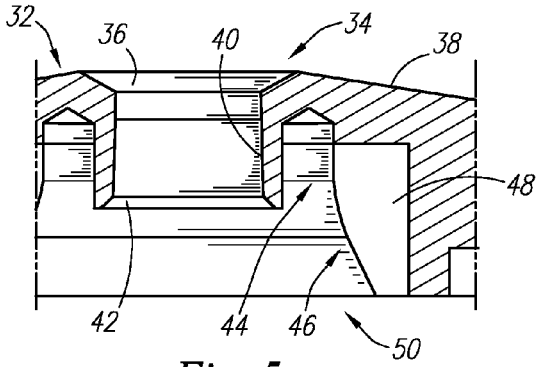
FIG. 5 is a cross-sectional view of a gas supply opening and a socket in the body of the gas burner in accordance with an aspect of the present invention.

The burner body 12 can also include a second elevated area 32 at a middle portion of the first elevated area 26. The center of the second elevated area 32 is provided with a gas supply opening 34 that extends vertically through the body 12 of the gas burner 10. As shown more clearly in FIG. 5, an upper end 36 of the gas supply opening 34 is tapered such that it widens at the opening of the top of the second elevated area 32. As also shown in FIGS. 4 and 5, the second elevated area 32 is formed with a gradual decline 38 from the gas supply opening 34 toward the periphery of the body 12. This configuration facilitates the flow of gas toward the periphery of the burner.

The sidewall 16 of the burner body 12 includes an igniter and a re-ignition chamber. The present example illustrates an oval-shaped burner in which the igniter and re-ignition chamber are adjacent to the second elevated area. The configuration of the oval-shaped body 12 is thus configured to channel gas from the gas supply opening 34 toward the longitudinal ends of the body 12.

As shown in FIGS. 4 and 5, a substantially cylindrical socket 50 is provided in a bottom portion of the body 12 and communicates with the gas supply opening 34. A tubular collar 40 projects downwardly from the second elevated area 32 into the socket 50 and defines a lower end 42 of the gas supply opening 34. The collar 40 is configured to receive a first end 62 of a gas supply conduit 60. The socket 50 can be substantially divided into an upper cylindrical section 44 and a lower tapered section 46 and further includes at least one radial depression 48 that substantially extends from the top of the cylindrical section 44 to the bottom of the tapered section 46. The present embodiment is configured with two radial depressions 48.

Figure 6:
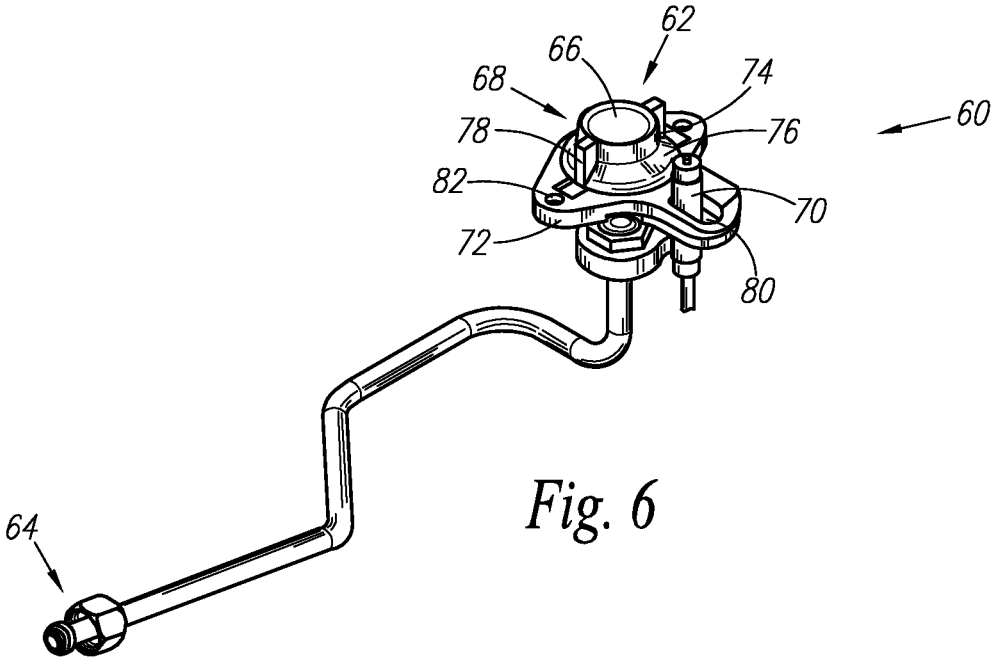
FIG. 6 is a perspective view of a gas supply conduit in accordance with an aspect of the present invention.

FIG. 6 shows an example embodiment of the gas supply conduit 60 that provides gas flow to the burner 10 through the gas supply opening 34. The conduit 60 includes a first end 62 and a second end 64. The second end 64 of the gas supply conduit 60 is in fluid communication with a gas source (not shown) while the first end 62 of the gas supply conduit 60 is configured with a structure to establish fluid communication between the gas supply conduit 60 and the gas burner 10. The first end 62 comprises an opening 66, an adjoining section 68, the igniter 70 and a clamping plate 72. The adjoining section 68 includes an upper cylindrical section 74 and a lower tapered section 76 that substantially correspond in shape to the socket 50. The adjoining section 68 further includes at least one radially outward protrusion 78 that engages the radial depression(s) 48 of the burner body. The radially outward protrusion 78 substantially extends from the top of the cylindrical section 74 to the bottom of the tapered section 76 of the adjoining section 68. In this embodiment, the gas supply conduit has two radial protrusions 78 located circumferentially opposite one another; however it is to be appreciated that different configurations of protrusions 78 can be employed. The clamping plate 72 also includes a slot 80 for receiving the igniter 70 and oppositely located holes 82 used to secure the clamping plate 72 and the first end 62 of the gas supply conduit 60 to the bottom surface 24 of the burner body 12 via fasteners. The igniter 70 in this embodiment is an electrode but other embodiments for creating a spark, flame or any other means of initiating combustion are also contemplated.

In FIG. 3, the bottom surface 24 of the burner body 12 is shown in accordance with an aspect of the present invention. The body 12 includes the gas supply opening 34, the socket 50, the depressions 48 and a plurality of apertures 84 configured to receive the adjoining section 68, the protrusions 78, the fasteners of the clamping plate 72, and the igniter 70. The collar 40 mates with the opening 66 as the adjoining section 68 of the gas supply conduit 60 is aligned with the socket 50. The adjoining section 68 and socket 50 are configured such that the depressions 48 and the protrusions 78 engage or mate with one another. In this way, the adjoining section 68 of the gas supply conduit 60 becomes aligned with the gas supply opening 34 in a predetermined manner and, thereafter, the clamping plate 72 can be secured to the gas burner 10.

The protrusion 78 may be called a tab, a flap, a beam, etc. and the depression 48 may be called a slot, a groove, a slit, etc. The present invention contemplates any structures used to restrict rotational movement of the adjoining section 68 of the gas supply conduit 60 about the socket 50 of the gas burner 10 as long as they are made of material sufficiently rigid to act as interlocking means. It is possible for the shapes of the protrusion 78 and the depression 48 to vary. In the present embodiment, the protrusion 78 and depression 48 have a rectangular cross section when cut along the depth of the socket 50 but variations in the shapes of the protrusions 78 and depressions 48 are also contemplated. Moreover, it is also possible for the body 12 of the gas burner 10 to be configured with the protrusion 78 and for the adjoining section 68 of the gas supply conduit 60 to be configured with the corresponding depression 48. Also, it is possible for the protrusion 78 to be formed in a radially inward manner on the adjoining section 68 or it is also possible for the protrusion 78 and the depression 48 to be formed in a non-radial manner. It is also not necessary for the protrusion 78 or the depression 48 to extend completely along the adjoining section 68 or the socket 50 respectively. Despite these variations, the protrusion 78 and the depression 48 still provide interacting, complementary parts of the interlocking means for limiting rotational movement and all of these variations are within the knowledge of a person of ordinary skill in the art and within the scope of the present invention.

A gas burner assembly includes the combination of the gas burner 10 and the gas supply conduit 60. The components of the gas burner 10, such as the cap 14 and the body 12, may be molded to integrate the above discussed features or may be formed from plural subcomponents. Moreover, the cap 14 and the body 12 may be made from ceramic, heat-treated metal or any other natural or processed material or combinations thereof having heat resistant characteristics. The same applies to the first end 62 of the gas supply conduit 60.

Figure 7:
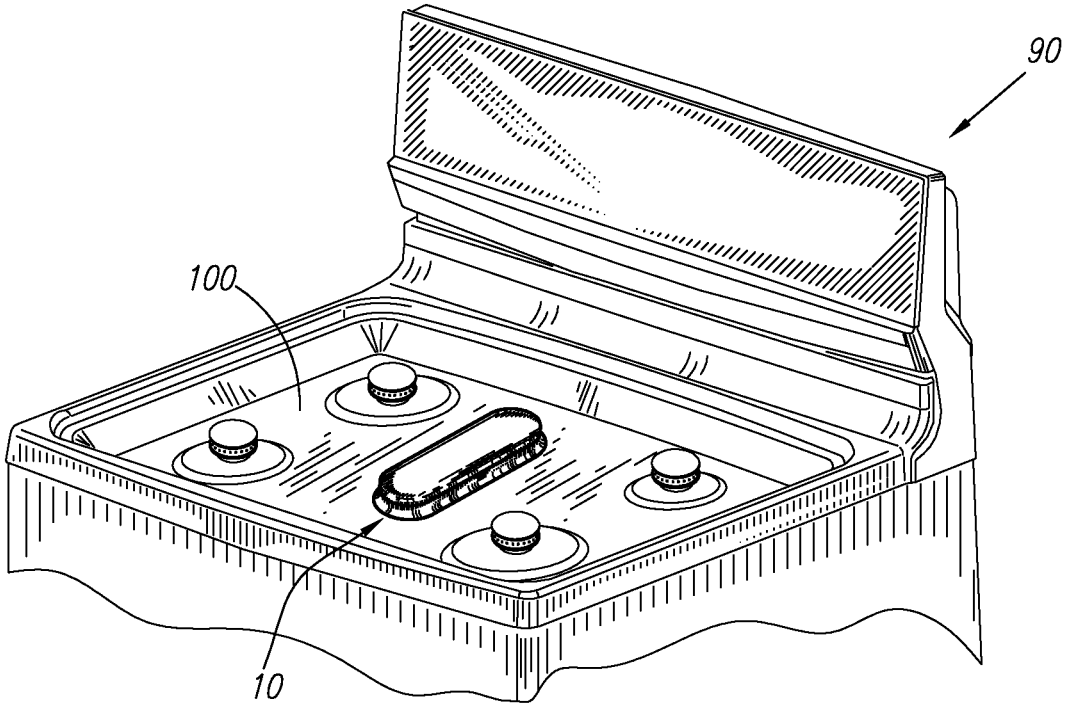
FIG. 7 is a perspective view of an apparatus in accordance with an aspect of the present invention.

FIG. 7 shows one embodiment of an apparatus 90 in which the present invention can be implemented. The apparatus 90 shown in FIG. 7 is a cooking appliance, or more specifically a free standing range, but the application of the present invention can also be applied to cooktops and moreover, is not limited to home appliances. The present invention is also applicable to any apparatus in which heating is provided through gas combustion such as outdoor stoves or furnaces. Moreover, although this example embodiment of the gas burner 10 has an elongate, oval or racetrack-like shape, the present invention may have applicability in other gas burners with different shapes.

In this embodiment, as shown in FIG. 7, the connection of the gas supply conduit 60 to the gas burner 10 can take place once the gas burner 10 is installed on the mounting surface 100. The gas supply conduit 60 can then be connected to the gas burner 10 by routing it from inside of the stove.

The present invention prevents the adjoining section 68 of the gas supply conduit 60 from rotating after it is fastened to the gas burner 10. Rotation of the adjoining section 68 of the gas supply conduit 60 can alter gas flow inside the chamber and can disrupt even distribution of gas at the perimeter of the chamber. The resulting effect is that the flame of the gas burner 10 may lose its symmetrical and aesthetically pleasing appearance. The protrusions 78 of the adjoining section 68 and the depressions 48 of the socket 50 interact to prevent rotation of the adjoining section 68 about the socket 50 and such a problem is avoided by the present invention.

It is to be appreciated that although an oval burner has been shown and discussed herein, the present invention is applicable to other non-conventionally shaped burner assemblies and such assemblies are intended to fall within the scope of the invention. What has been described above includes example implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations of the present invention.

It should be evident that this disclosure is by way of example and that various changes may be made by adding, modifying or eliminating details without departing from the fair scope of the teaching contained in this disclosure. The invention is therefore not limited to particular details of this disclosure.

What is claimed is:

1. A gas burner assembly comprising:

a molded gas burner body with a bottom surface and a perimeter of a non-circular geometry and a plurality of flame openings disposed about the perimeter, the gas burner body having a gas supply opening and at least one depression formed into said bottom surface so as to not extend outward of said bottom surface, wherein at least some of the plurality of flame openings are spaced at different distances relative to the gas supply opening; and a gas supply conduit comprising an opening and an adjoining section proximate the opening, the adjoining section having at least one protrusion configured to removably engage the at least one depression in the gas burner body, wherein the at least one protrusion and the at least one depression are configured to slidingly engage one another such that the gas supply conduit is nonrotatably engaged with the gas burner body and such that the gas supply conduit is removable from the gas burner body through linear movement only, and wherein the gas supply opening is maintained in alignment with the opening of the gas supply conduit when the at least one protrusion and the at least one depression are engaged.

2. The gas burner assembly of claim 1, further comprising a socket formed in the gas burner body.

3. The gas burner assembly of claim 2, wherein the at least one depression is proximate the socket.

4. The gas burner assembly of claim 3, wherein the adjoining section has at least one section dimensioned to create a sliding fit with the socket.

5. The gas burner assembly of claim 1, wherein the at least one protrusion is oriented outward from the adjoining section.

6. The gas burner assembly of claim 1, wherein the at least one protrusion and the at least one depression extend substantially along the depth of a socket formed in the burner body.

7. The gas burner assembly of claim 1, wherein the at least one protrusion and the at least one depression have rectangular cross sections.

8. The gas burner assembly of claim 1, wherein the gas burner has a non-circular shape.

9. The gas burner assembly of claim 8, wherein the gas burner is substantially oval.

10. The gas burner assembly of claim 1, further comprising a mounting surface on which the gas burner body is installed.

11. A gas burner assembly including:

a molded gas burner with a bottom surface and a perimeter of a non-circular geometry and a plurality of flame openings disposed about the perimeter, the gas burner further having a gas supply opening and a first locator formed as a depression in said bottom surface and having a boundary defined by said bottom surface, wherein at least some of the plurality of flame openings are spaced at different distances relative to the gas supply opening; and a gas supply conduit having an opening at an end and a second locator positioned proximate the opening, wherein the first locator is configured to slidingly engage the second locator such that the gas supply conduit is nonrotatably engaged with the gas burner, the gas supply opening is maintained in alignment with the opening of the gas supply conduit, and such that the gas supply conduit is removable from the gas burner through linear movement only.

12. The gas burner assembly of claim 11, wherein the second locator includes a projection corresponding to said depression.

13. The gas burner assembly of claim 11, wherein the first locator extends radially with respect to the gas supply opening and the second locator extends radially with respect to the opening.

14. The gas burner assembly of claim 11, wherein the gas burner includes two first locators and the gas supply conduit includes two second locators.

15. The gas burner assembly of claim 11, wherein, once the first locator is engaged to the second locator, the first locator and the second locator extend axially and radially about the gas supply conduit.

16. The gas burner assembly of claim 15, wherein the first locator and the second locator have rectangular cross-sections.

17. A gas burner assembly including:

a molded gas burner with a bottom surface and a perimeter of a non-circular geometry and a plurality of flame openings disposed about the perimeter, the gas burner further including a gas supply opening and a socket formed around the gas supply opening and into said bottom surface so as to not extend outward of said bottom surface, the socket including a first part of an interlocking means; and a gas supply conduit including an opening at an end and an adjoining section proximate to the opening, the adjoining section configured to removably mate with the socket and including a second part of the interlocking means, wherein the first part and second part slidingly interlock so that, once the gas supply conduit is connected to the gas burner, the gas supply opening is maintained in alignment with the opening of the gas supply conduit, the adjoining section is not rotatable about the socket in any direction and the adjoining section is removable from the socket through linear movement only.

18. The gas burner assembly of claim 17, wherein, once the gas supply conduit is connected to the gas burner, the first part and the second part extend axially and radially about the gas supply conduit.

19. The gas burner assembly of claim 18, wherein the first part and the second part have rectangular cross-sections.

* * * * *